US005079597A

United States Patent [19]

Mauer et al.

[11] Patent Number: 5,079,597

[45] Date of Patent: Jan. 7, 1992

[54] CLEANING METHOD AND APPARATUS FOR INTERMEDIATE TRANSFER MEMBER

[75] Inventors: Andrew J. Mauer; Victor C. Solomon, both of Rochester, N.Y.

[73] Assignee: Eastman Kodak Company, Rochester, N.Y.

[21] Appl. No.: 632,808

[22] Filed: Dec. 24, 1990

[51] Int. Cl.[5] ..... G03G 21/00

[52] U.S. Cl. ..... 355/303; 355/274; 355/296

[58] Field of Search ..... 15/1.51; 355/200, 270, 355/271, 274, 296, 303

[56] References Cited

U.S. PATENT DOCUMENTS

| | | | |
|---|---|---|---|
| 4,081,212 | 3/1978 | Wetzer | 355/274 |
| 4,183,655 | 1/1980 | Umahashi et al. | 355/274 |
| 4,479,709 | 10/1984 | Syukuri et al. | 355/296 |
| 4,588,279 | 5/1986 | Fukuchi et al. | 35/271 |
| 4,712,906 | 12/1987 | Bothner et al. | 355/271 |
| 4,899,198 | 2/1990 | Mahoney | 355/297 |

FOREIGN PATENT DOCUMENTS

| | | | |
|---|---|---|---|
| 0149079 | 6/1989 | Japan | 355/296 |

*Primary Examiner*—A. T. Grimley
*Assistant Examiner*—P. Stanzione
*Attorney, Agent, or Firm*—Tallam I. Nguti

[57] ABSTRACT

In an electrostatographic machine such as a copier or printer, a cleaning apparatus for removing charged and uncharged particles from the surface of an image-transfer assist member such as an intermediate transfer member. The cleaning apparatus includes a plurality of potential sources for selectively biasing the intermediate transfer member and the image-bearing member of the machine, and a dc corona discharge device for actively charging such particles on the intermediate transfer member for transfer back to the image-bearing member.

12 Claims, 2 Drawing Sheets

CLEANING METHOD AND APPARATUS FOR INTERMEDIATE TRANSFER MEMBER

BACKGROUND OF THE INVENTION

1. Field of the Invention

The present invention relates to cleaning methods and apparatus for removing particles from surfaces in electrostatographic reproduction machines such as copiers and printers. More particularly, it relates to a method and apparatus for removing charged and uncharged particles from the image-bearing surface of an intermediate transfer member in such a machine.

2. Description Relative to the Prior Art

Electrostatographic process apparatus or machines, such as copiers and printers, which produce or reproduce toned images on receiver sheets are well known. In such machines, a toner particle image is formed on a moving image-bearing member, and is subsequently transferred onto a suitable receiver sheet, such as a sheet of paper. The transferred toner image is then fused onto the sheet to form a hard copy. Such hard copy production can be repeated over and over when a plurality of copies is desired. In order to ensure the quality of each subsequently produced image, each such apparatus or machine usually includes a cleaning device for removing residual particles, for example, from the surface of the image-bearing member.

As disclosed, for example, in U.S. Pat. No. 4,081,212, issued Mar. 28, 1978 to Wetzer, and in U.S. Pat. No. 4,183,655, issued Jan. 15, 1980 to Umahashi et al., in one group of such apparatus, the toner particle image formed on the image-bearing member is ordinarily transferred directly from such surface to a receiver sheet which is fed through an image transfer nip that is formed by the image-bearing member and a back up transfer-nip roller. During such transfer, the transfer-nip back up roller directly contacts the back of the receiver sheet in areas where such sheet is present, but undesirably also contacts the image transfer member in areas where there is no sheet. As such, the transfer-nip back up roller can become contaminated with toner and other particles which transfer from the image-bearing member onto the roller in such no-sheet areas. Accordingly, means are usually provided for cleaning such back up rollers as disclosed, for example, in the above-cited patents.

Another group of such electrostatographic machines or apparatus are disclosed for example in (a) U.S Pat. No. 4,712,906, issued Dec. 15, 1987 to Bothner et al., (b) U.S. Pat. No. 4,588,279, issued May 13, 1986 to Fukuchi et al., and (c) U.S. Pat. No. 4,899,198, issued Feb. 6, 1990 to Mahoney. This group includes those machines or apparatus capable of producing color images. As disclosed, each of them includes either a transfer member (TM) or an intermediate transfer member (ITM). In those machines that include a transfer member (TM), the toner particle images are formed on the image-bearing member, a receiver sheet is attached to the transfer member (TM,) and then moved repeatedly, for example, through an image-transfer nip formed by the TM and the image-bearing member for receiving the toner images thereonto. In those machines that include an intermediate transfer member (ITM), the toner particle images formed on the image-bearing member are first transferred to the ITM before they are then transferred from such ITM to a receiver sheet. The ITM therefore forms a pair of toner image transfer-nips, one with the image-bearing member and the other with a back up transfer-nip roller. The transfer-nip roller forms a transfer nip with the ITM through which the sheet is fed for receiving the toner images from the ITM. As discussed above, the back up transfer-nip roller in this case can similarly become contaminated with toner particles and must therefore be cleaned.

Additionally, however, the TM and the ITM can and do also become contaminated with residual toner particles as well as with other particles, for example, paper dust particles from sheets such as sheets of paper carried by the TM or fed into contact with the ITM. Such contamination of the TM or ITM is particularly a problem when different color toner particles are used to form a multiple color toner images in such machines.

Because the residual particles which contaminate transfer assist members (TAM) such as the transfer nip back up roller, the transfer member TM or the ITM include toner as well as other particles such as dust particles, some of such particles, as can be expected, will be charged and others will be uncharged. Furthermore, in the case of charged particles, the exact polarity of each particle is ordinarily not known precisely. Therefore, attempting to remove all such particles from a TAM (transfer assist member) merely by reversing the relative polarity of such a member can often be significantly ineffective. The alternative, of course, is to use a separate and dedicated cleaning device.

Such cleaning devices for removing contaminating particles from an ITM are disclosed, for example, in the above cited patents U.S. Pat. No. 4,588,279 and U.S. Pat. No. 4,899,198. Such cleaning devices, however, are usually separate or bulky and expensive. In addition, the effectiveness of each may still be detrimentally affected by the presence of charged and uncharged particles among such particles on the ITM.

SUMMARY OF THE INVENTION

It is an object of the present invention to provide a simple, and relatively less bulky cleaning method and apparatus for removing residual particles from a transfer assist member (TAM) such as an intermediate transfer member (ITM) of an electrostatographic machine, such as a copier or printer.

It is another object of the present invention to provide such a cleaning method and apparatus for effectively removing charged and uncharged particles from such a transfer assist member (TAM).

In accordance with the present invention, a cleaning apparatus is provided for removing charged and uncharged particles from movable intermediate transfer member (ITM) of an electrostatographic machine. The cleaning apparatus of the present invention includes a first biasing means for selectively biasing the movable image-bearing member of the electrostatographic machine to a first potential $V_1$ which has a first polarity $P_1$, or to a second potential $V_2$ which has a second polarity $P_2$. The cleaning apparatus further includes a second biasing means for selectively biasing the intermediate transfer member (ITM) of the machine to a fourth or a fifth potential $V_4$, $V_5$, respectively, which have fourth and fifth polarities $P_4$, $P_5$, respectively, such that $P_4$ and $P_5$ are each relatively opposite to $P_2$. The cleaning apparatus of the present invention also includes a corona discharge device for actively charging all charged and uncharged particles on the ITM to a sixth potential $V_6$ that has a sixth polarity $P_6$. The polarity $P_6$ should be relatively the same as the fourth polarity $P_4$ of the fourth potential of the ITM, and hence should be relatively opposite to $P_2$ so as to cause the actively charged particles to transfer from the ITM back to the image-bearing member.

According to another aspect of the present invention, a cleaning method for removing charged and uncharged particles from a moving intermediate transfer member (ITM) forming an image transfer nip with the moving image-bearing member of an electrostatographic machine includes the steps of (a) selectively biasing the image-bearing member to a potential $V_2$ having a polarity $P_2$, (b) selectively biasing the ITM to a potential $V_5$ having a polarity $P_5$ such that $P_5$ is relatively opposite to $P_2$; and(c) activating a corona discharge device for actively charging all particles on the ITM to a potential $V_6$ having a polarity $P_6$ which is relatively the same as $P_5$, and hence relatively opposite to $P_2$, thereby causing all such actively charged particles to transfer from the ITM back to the image-bearing member.

BRIEF DESCRIPTION OF THE DRAWINGS

In the detailed description of the invention presented below, reference is made to the drawings, in which.

DETAILED DESCRIPTION OF THE PREFERRED EMBODIMENT

Because electrostatographic process apparatus or machines are well known, the present description will be directed in particular to elements forming part of or cooperating more directly with the present invention. Elements not specifically shown or described herein are selectable from those known in the prior art.

Figure 1:
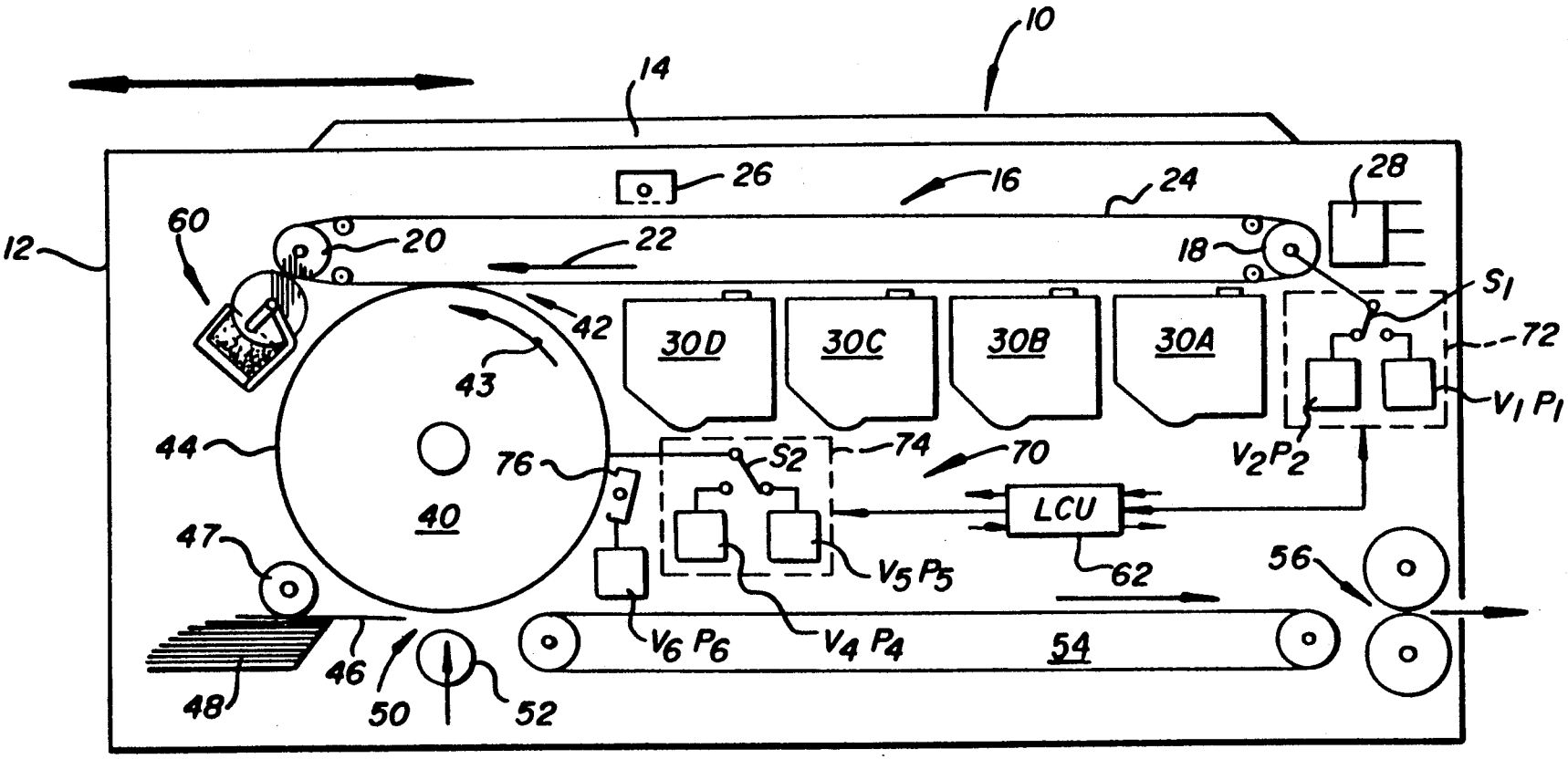
FIG. 1 is a schematic of an electrostatographic machine including the cleaning apparatus of the present invention.

Referring now to FIG. 1, an electrostatographic process apparatus or machine such as a copier or printer is generally illustrated as 10. As is well known, such a machine 10 can produce or reproduce hard copy toned images on suitable receiver sheets. As shown, the copier or printer 10 includes a housing 12, a platen 14, and an image-bearing member 16 which is shown as an endless flexible belt trained about a plurality of rollers 18, 20. One of the rollers 18, 20, for example the roller 20, can be a drive roller for moving the member 16, for example, in the direction of the arrow 22. As is well known, the image-bearing member 16 can also be a rotatable rigid drum. In any case, the member 16 has an image-bearing surface 24, which for imaging purposes has an uncharged potential, for example $V_1$ having a polarity $P_1$. Charges at a desired potential having a desired polarity can then be uniformly sprayed on the surface 24. The values for $V_1P_1$, for example ground, should be selected such that in pos/pos development type machines, in which the image pattern to be developed consists, for example, of fully undischarged areas of the surface 24, toner particles are prevented from being attracted to the fully discharged areas of the surface 24 at $V_1P_1$. In neg/pos or reverse development type machines the opposite is, of course, the case.

As is known in the art, the copier or printer 10 includes a logic and control unit (LCU) 62 for variously controlling the electrostatographic process of the copier or printer 10 based, for example, on the sensed instantaneous location of the moving image-bearing member 16. The LCU 62, for example, has a digital computer, preferably a microprocessor which includes stored programs that are responsive to sensed input signals for sequentially actuating and deactuating the various process stations and components of the copier or printer 10, as well as for controlling the various functions of each station and component. Additional encoding means may be provided as known in the art for providing desired precise timing signals for the control of the various functions and components. Programming of a number of commercially available microprocessors such as an INTEL Model 8086 Microprocessor (which along with others can be used in the LCU 62 according to the present invention) is a conventional skill in the art.

Under the control of the LCU 62, the copier or printer 10 can selectively be set to an imaging mode in which the various stations and components of the copier cycle so as to form, transfer and fuse toned images. Under such control, the copier or printer 10 can be similarly set to a non-imaging mode in which the various stations and components of the copier or printer 10 cycle such that no images are formed, transferred or fused. In other words, in the non-imaging mode, the copier or printer 10 and the various stations and components perform what can be described as a dry-run.

For forming toned images on the surface 24, the copier or printer 10 includes a first corona discharge device 26, for example an ac corona device with a suitable biased control grid electrode, for uniformly and electrostatically charging the surface 24. A latent image-forming device 28, such as an LED printhead, for example, is used for image-wise exposing the uniformly charged surface 24 thereby forming an electrostatic latent image pattern on the surface 24. A plurality of development stations 30A, 30B, 30C and 30D, for example, each contains developer material which may include carrier particles and toner particles of different colors, such as cyan, magenta, yellow and black. The toner particles in the developer material are charged to a desired potential, for example, $V_3$ having a polarity $P_3$ that, for example, is relatively the same as that $P_1$ of the background areas of the surface 24. As is well known, $P_3$ is also relatively opposite to the polarity of the image pattern areas on the surface 24 that are to be developed with such charged toner particles. As such, latent images formed electrostatically on the surface 24 can be developed or made visible by such charged toner particles being attracted onto such latent images.

As is well known, the polarity of a charged body is ordinarily positive or negative when the body is charged to, respectively, a positive or negative potential. The polarity of a first positively charged body, however, may be relatively negative to that of a second positively charged body if the second body is charged to a higher positive potential than the first. The electrostatic transfer of charged particles as discussed here relies on the attraction and repulsion characteristics of opposite and relatively opposite polarity bodies, and same and relatively same polarity bodies, respectively. Because the selection of same, opposite, relatively same and relatively opposite polarities may be varied, as desired, for various purposes throughout the electrostatographic process of the machine or apparatus 10 of the present invention, the relevant polarities of the various bodies or members described will be labeled $P_1$, $P_2$, $P_3$, etc., for ease of identification. Each such polarity, however, is simply positive or negative relative to another.

As further shown, the copier or printer 10 includes an image transfer assist member (TAM) such as an intermediate transfer member (ITM) 40. The member 40 is shown as a drum but can also be a flexible web. In either case, the member 40 forms a first toner image transfer nip 42 with the surface 24 of the image-bearing member 16. The transfer nip 42 is formed, as such, at a point that is downstream of the development stations 30A-30D, relative to the movement of the image-bearing member 16. The principles of the present invention will be described with specific reference to the cleaning of an image transfer assist member (TAM) that is an intermediate transfer member (ITM). It is understood, however, that the invention is equally applicable to the cleaning of other types of transfer assist members such as a transfer-nip back up roller or a transfer member to which the receiver sheet is attached for repeated movement, if necessary, through a toner image transfer nip such as 42.

The ITM 40, as shown, has an image-bearing surface 44, and for image transfer purposes is biasable, for example, to a potential $V_4$ having a polarity $P_4$ that is relatively opposite to the polarity $P_3$ of the toner particles of the toned images on the surface 24. The ITM 40 is rotatable, for example, in the direction of the arrow 43 for receiving, in registration, toned images from the surface 24. As such, the copier or printer 10 can produce a multiple color toner image by forming successive, different color toned color-separation components of such a multiple color image, and then transferring such components, in registration, onto the surface 44. By so doing, a toned composite of the multiple color image can be created on such surface 44.

The composite multiple color toned image (on the surface 44) can thereafter be transferred from the surface 44 to a suitable receiver such as a sheet of paper 46. As shown, the sheet 46 can be fed, for example, by a roller 47, from a supply 48 thereof, through a second toner image transfer nip 50. The nip 50 is formed by the ITM 40 with an articulatable back up roller 52 which during image transfer thereat directly contacts the back of the receiver sheet 46 The roller 52, however, is articulated away from the ITM 40 during image composition on the surface 44. As further shown, the copier or printer 10 includes sheet transport means 54 for moving the image-carrying sheet 46, from the nip 50 to a fusing station 56 where the toned image is fused onto such sheet. As such, the copier or printer 10 can repeatedly form, transfer and fuse such toned images as desired.

However, in order to form high quality images on the image-bearing surface 24 repeatedly, each portion of such surface 24, from which a toned image has been formed and transferred to the ITM 40, must be thoroughly cleaned, for example, by a cleaning device 60, before such portion is again used for forming another image.

The quality of subsequently produced images is also affected by the cleanliness condition of the surface 44 of the ITM 40. It should be noted that the composition of toned images on the surface 44, and the subsequent transfer of such images to the sheet 46, result in contamination of the surface 44 with toner and, for example, dust particles, some of which are charged and others of which are uncharged. Accordingly, the surface 44 must therefore be cleaned periodically in order to ensure continued composition thereon and transfer therefrom of high quality images. Therefore, in accordance with the present invention, a cleaning apparatus designated generally 70 is provided for effectively removing such charged and uncharged particles from the surface 44. The apparatus 70, and the method thereof, are simple and relatively less bulky and less expensive than conventional dedicated cleaning apparatus for such purpose. The method and apparatus 70 are operable when the copier or printer 10 is selectively set to the non-imaging mode. As shown, the apparatus 70 includes first and second biasing means 72, 74, and a second corona discharge device 76.

The first biasing means 72, which is under the control of the LCU 62, includes a potential source for the first potential $V_1$ of the image-bearing member which may be ground, and which has a polarity $P_1$, a second potential source $V_2$ which has a polarity $P_2$, and means such as a switch $S_1$ under the control of the LCU 62 for selectively biasing the image-bearing member 16 to either $V_1P_1$ or $V_2P_2$. The potential $V_2$ polarity $V_2$ here is that of the surface or member that will receive the contaminating particles from the transfer assist member (TAM) being cleaned. In o the case of the ITM 40, the values for $V_2P_2$ should be selected so as to facilitate the transfer from the surface 44 of the ITM 40, of relatively oppositely charged toner and other particles, directly onto the surface 24 of the member 16 when such surface 24 is not charged by the corona device 26 and hence not developed by developer from any of the stations 30A-30D.

The second biasing means 74, which also is under the control of the LCU 62, includes a potential source for the fourth potential $V_4$ of the ITM 40 which has a polarity $P_4$, a fifth potential source $V_5$ which has a polarity $P_5$, and means such as a switch $S_2$ for selectively biasing the ITM 40 to either $V_4P_4$ or $V_5P_5$. The polarities $P_4$ and $P_5$ should each be relatively opposite to the second polarity $P_2$ of the image-bearing member 16 in order to facilitate the transfer of charged particles from the ITM 40 to the member 16. The difference between $V_4P_4$ and $V_2P_2$, however, should be greater than that between $V_5P_5$ and $V_2P_2$. In a preferred embodiment, for example, $V_5P_5$ is ground and $V_2P_2$ is positive (that is higher than ground), and $V_4P_4$ is about $-2000V$ dc.

As further shown, the corona discharge device 76 of the cleaning apparatus 70, can be an open cell, single wire dc corona. Under the control of the LCU 62, the device 76 can be selectively activated to actively charge all particles (previously charged as well as uncharged), that desirably should be removed from the surface 44 of the ITM 40. The device 76, as such, can actively charge such particles to a potential and polarity shown, for example, as $V_6P_6$. The source $V_6P_6$ is such that the polarity $P_6$ is relatively the same as that of $P_4$ of the ITM 40 so as to cause the ITM 40 to repel such actively charged particles.

Figure 2:
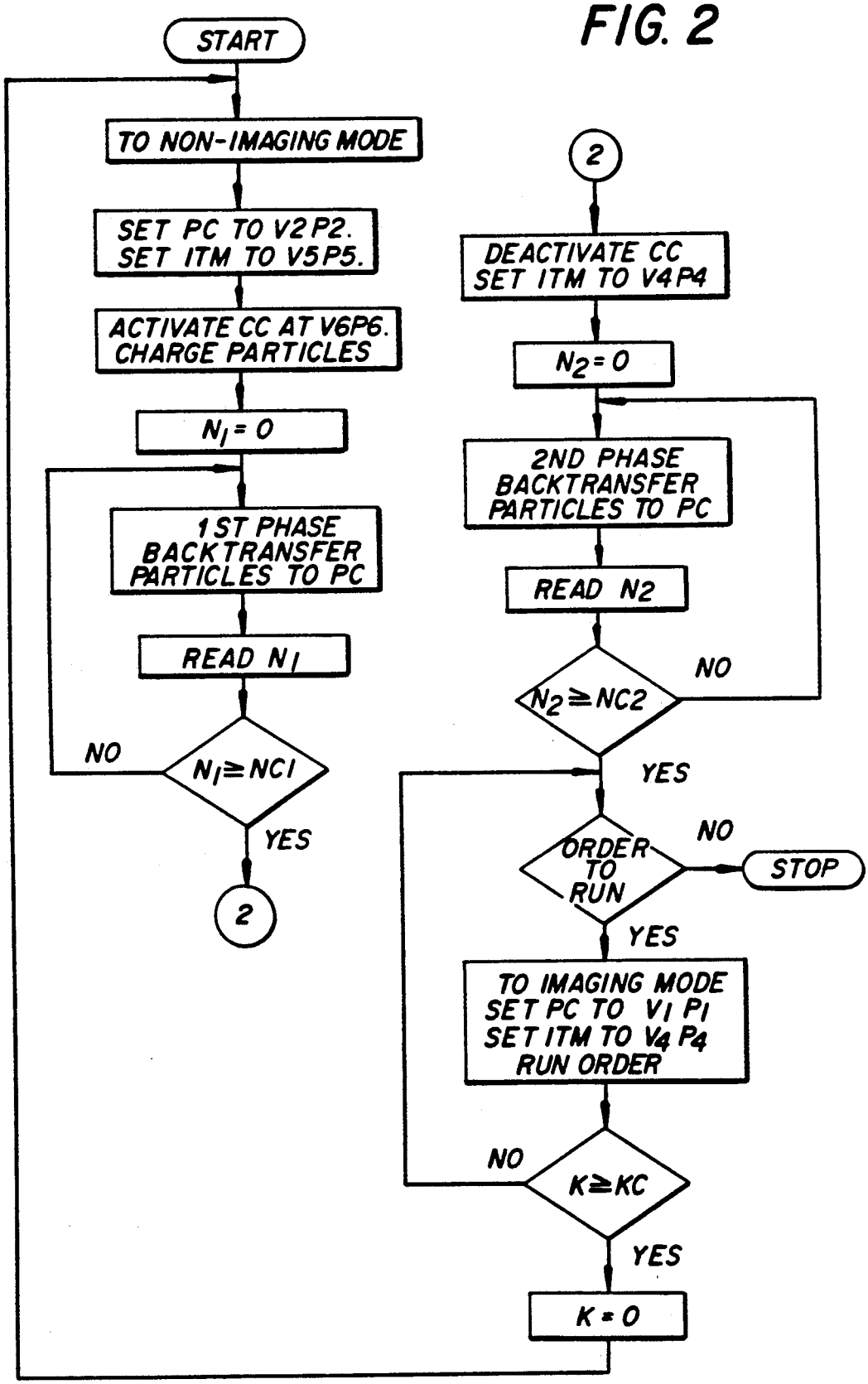
FIG. 2 is a flow chart of the operation of the machine of FIG. 1 including a series of steps of the method of the present invention.

Referring now to FIG. 2, there is shown a flow chart including a series of steps used in the method of the present invention. As shown, when the copier or printer 10 is first turned on, or when the number of images K formed and transferred thereby has reached a predetermined value, for example, $K_c$, as counted by the LCU 62 the copier or printer 10 under the control of the LCU 62 can be set to the non-imaging mode in which the ITM 40 can then be cleaned according to the present invention. The series of steps for such cleaning include: (a) selectively biasing the moving image-bearing member 16 to $V_2P_2$, for example, a positive potential having a positive polarity; (b) selectively biasing the moving ITM 40 at $V_5P_5$, where $V_5P_5$, for example, is ground, such that $P_5$ is relatively opposite to $P_2$; and (c) activating the corona discharge device 76 to actively charge all particles on the surface 44 of the ITM 40 to $V_6P_6$, such that $P_6$ is relatively opposite to $P_2$, for example, negative. As such, in a first phase of the present invention, when the surfaces 44 of the ITM 40 and that 24 of the image-bearing member 16 make contact within the image-transfer nip 42, the actively charged particles on the surface 44 with a polarity $P_6$, will tend to transfer to the surface 24 which has the polarity $P_2$ relatively opposite to $P_6$. Such particles can thereafter be removed conventionally from the surface 24 by means, for example, of the image-bearing-member cleaning device 60 which can be a blade or a fiber brush.

To ensure effective removal of such actively charged particles from the surface 44 of the ITM 40, the cleaning method of the present invention includes a second cleaning phase. In the first phase, when the ITM 40 was at $V_5P_5$, and the corona device 76 was kept activated, the ITM 40 should be moved through the nip 42 for a number of complete revolutions $N_1$, where $N_1$ is at least greater than 1. A predetermined number, for example, NC1 of such revolutions $N_1$ can be used during the first cleaning phase in order to ensure substantial cleaning of the ITM 40. In the second phase, the method of the present invention additionally includes the steps of (a) selectively rebiasing the ITM 40 from $V_5P_5$, such as ground, to $V_4P_4$, for example, −2000V dc, such that $P_4$ is relatively the same as $P_6$, and such that the difference between $V_4$ and $V_2$ is substantially greater than that between $V_5$ and $V_2$; (b) deactivating the corona device 76; and (c) moving the ITM 40 for a predetermined number of revolutions $N_2$, for example, NC2 (where NC2 is at least greater than 1) through the nip 42. By so doing, even more of the actively charged particles with polarity $P_6$ on the ITM 40 will be repelled by the surface 44 at $V_4P_4$ (while also being attracted by the surface 24 at $V_2P_2$) onto the surface 24. Such first and second phase cleaning or removal of the actively charged particles from the surface 44 ensures that substantially all such particles are removed from such surface 44.

As can be seen, the method and apparatus of the present invention is simple, not bulky, and is therefore relatively less expensive. The active charging of particles on the ITM 40 as well as the first and second phase cleaning method advantageously ensure the removal of substantially all as well as both charged and uncharged particles therefrom.

The invention has been described in detail with particular reference to a presently preferred embodiment, but it will be understood that variations and modifications can be effected within the spirit and scope of the invention.

What is claimed is:

1. In an electrostatographic machine including a moving image-bearing member forming an image transfer nip with a moving intermediate transfer member-(ITM), a cleaning apparatus for removing charged and uncharged particles from the ITM, the cleaning apparatus including:

(a) first biasing means for selectively biasing the image-bearing member to a first or second potential, said first and second potentials having first and second polarities respectively, and said first biasing means including first and second potential sources, switch means, and a logic and control unit;

(b) second biasing means for selectively biasing the intermediate transfer member (ITM,) to a fourth or fifth potential, said fourth and fifth potentials having fourth and fifth polarities, respectively, and said fourth and fifth polarities being relatively opposite to said second polarity of said second potential of the image-bearing member; and (c) a corona discharge device mounted adjacent the ITM for actively charging all particles on the ITM to a sixth potential having a sixth polarity, said sixth polarity being relatively the same as said fourth polarity of said fourth potential of the ITM and hence relatively opposite to said second polarity of said second potential of the image-bearing member.

2. The cleaning apparatus of claim 1 wherein said second biasing for biasing the ITM includes a pair of potential sources, switch means, and a logic and control unit.

3. The cleaning apparatus of claim 1 wherein said corona discharge device consists of an open cell single wire dc corona charger.

4. The cleaning apparatus of claim 1 wherein said second biasing potential of the image-bearing member is such as to facilitate the transfer of relatively oppositely charged particles to transfer directly onto an uncharge image-bearing member.

5. The cleaning apparatus of claim 1 wherein the difference between the fourth potential of the ITM and the second potential of the image-bearing member is greater than that between the fifth potential of the ITM and such second potential of the image-bearing member.

6. An electrostatographic machine operable in an imaging mode for producing toned images on receiver sheets, the machine including:

(a) latent image-forming means, including a first corona charging device and an image-bearing surface selectively biasable at a first potential having a first polarity for electrostatically forming on said image-bearing surface a latent charge image pattern;

(b) development means for toning said latent image pattern, said development means including charged toner particles;

(c) an image transfer assist member (TAM) for assisting the transfer of the toned image from said image-bearing surface onto a receiver sheet, said transfer assist member being biased to a desired potential having a desired polarity;

(d) first cleaning means for removing residual toner particles from said image bearing surface;

(e) means for selectively operating said machine in an imaging mode or in a non-imaging mode; and (f) second cleaning means operable when said machine is in a non-imaging mode for removing charged and uncharged particles from said image transfer assist member, said second cleaning means including a second corona charging device for actively charging all particles on said image transfer assist member to a desired potential having a polarity that is relatively the same as said polarity of said image transfer assist member (TAM), means for biasing said TAM to another desired potential, and means for selectively activating and deactivating said second corona charging device.

7. The machine of claim 6 wherein said first polarity of said image-bearing surface is positive.

8. The machine of claim 6 wherein said image transfer assist member is an intermediate transfer member.

9. The machine of claim 6 wherein said second corona charging device is an open cell single wire dc corona charger.

10. The machine of claim 8 wherein said intermediate transfer member is a drum.

11. A cleaning method for removing charged and uncharged particles from a moving image transfer member assist (TAM) forming an image-transfer nip with a moving image-bearing surface in an electrostatographic machine, the method including the steps of:

(a) selectively switching the operation of said machine from an imaging mode to a non-imaging mode and selectively biasing the image-bearing surface to a potential $V_2$ having a polarity $P_2$, (b) selectively biasing the image transfer assist member (TAM) to another potential $V_5$ having a polarity $P_5$; and (c) activating a corona discharge device for actively charging all particles on the TAM to a potential $V_6$ having a polarity $P_6$ such that said polarity $P_6$ is relatively the same as $P_5$ and hence opposite to $P_2$ so as to cause such actively charged particles to tend to transfer from the TAM at $V_5P_5$ back to the image-bearing surface at $V_2P_2$ for subsequent cleaning therefrom by an image-bearing-surface cleaning device.

12. The cleaning method of claim 11 further including the steps of:

(i) selectively changing the biasing on the TAM from the potential $V_5$ having a polarity $P_5$ to a different potential $V_4$ having a polarity $P_4$ such that the difference between $V_4P_4$ and $V_2P_2$ is greater than that between $V_5P_5$ and $V_2P_2$;

(ii) deactivating said corona discharge device; and (iii) moving the TAM through the image-transfer nip so as to effectively transfer substantially all such actively charged particles from the TAM to the image-bearing surface.

* * * * *